United States Patent [19]

Chantalat

[11] Patent Number: 4,974,372

[45] Date of Patent: Dec. 4, 1990

[54] UNIVERSAL DEVICE FOR SHARPENING DRILL BITS

[76] Inventor: Vinit P. Chantalat, 11681 Dawson Dr., Los Altos Hills, Calif. 94022

[21] Appl. No.: 336,831

[22] Filed: Apr. 12, 1989

[51] Int. Cl.[5] ..... B24B 1/00; B24B 7/19

[52] U.S. Cl. ..... 51/288; 51/219 R

[58] Field of Search ..... 51/219 R, 288

[56] References Cited

U.S. PATENT DOCUMENTS

| | | | |
|---|---|---|---|
| 2,415,121 | 2/1947 | Wiken et al. | 51/219 R |
| 3,056,237 | 10/1962 | Comiskey, Sr. | 51/219 R |
| 3,067,550 | 12/1962 | Schultz | 51/219 R |
| 3,952,459 | 4/1976 | Negley | 51/219 R |
| 4,031,672 | 6/1977 | Moores, Jr. et al. | 51/288 |
| 4,142,332 | 3/1979 | Clarke | 51/219 R |
| 4,164,100 | 8/1979 | Wolff | 51/219 R |
| 4,547,999 | 10/1985 | Reiling et al. | 51/219 R |
| 4,566,227 | 1/1986 | Wolff | 51/219 R |
| 4,658,549 | 4/1987 | Lockwood | 51/219 R |
| 4,769,955 | 9/1988 | Reiling et al. | 51/219 R |

*Primary Examiner*—Frederick R. Schmidt

*Assistant Examiner*—Mark F. Frazier

*Attorney, Agent, or Firm*—Flehr, Hohbach, Test, Albritton & Herbert

[57] ABSTRACT

A sharpening device for sharpening drill bits on the flat surface of an electric grinding wheel or on a flat surfaced sharpening stone. The device includes a vise type drill bit holder which can accommodate various sizes of drill bits, the vise type holder having a slotted and angled set of jaws for positioning the drill bit at the correct grinding angle to the grinding surface. The holder is supported by handles such that the holder can be manually swivelled during a grinding process. A calibrated gauge for adjusting the protrusion of the drill bit from the holder is provided to obtain the correct lip angles. The sharpening device includes threads on the spindle about which the sharpening device rotates so that the drill bit moves sideways parallel to the grinding surface during grinding to prevent excessive wear in one spot on the grinding surface to thereby redress the grinding surface. Alternate means of supporting the holder are available including manually holding the device.

17 Claims, 8 Drawing Sheets

ALIGNMENT CHART FOR 3 VARIABLES (R/C, D/C OR PL/C, RA) HAVING Y, S, C AS CONSTANTS FROM FORMULA 1

UNIVERSAL DEVICE FOR SHARPENING DRILL BITS

BACKGROUND OF THE INVENTION

1. Field of the Invention

This invention relates to a method and a device for sharpening spiral and twist drill bits on the flat surface of a grinding wheel of a bench grinder or on the flat surface of a sharpening stone.

2. Prior Art

The number of commercially available drill bit grinders, or sharpeners, both powered and manual, are few in number. What is available is either too expensive for home use or is too complicated to consistently achieve the same results. Consequently, a large number of blunt and worn drill bits are being thrown away. Some powered drill bit grinders produce satisfactory results but are too expensive or too complicated to use and require frequent changing of the grinding wheel since no redressing of the grinding surface is provided during grinding. Others do not produce satisfactory results, due primarily to wrong assumptions made as to how a drill bit should be reground.

A review of some of the U.S. patents granted on drill bit grinders or sharpeners indicates three basic types: first, the completely automated type where the grinding wheel and the grinding apparatus are incorporated into one unit such as that disclosed in U.S. Pat. Nos. 4,031,672 and 4,001,975; second, a sharpener device employing an electric drill such as U.S. Pat. No. 4,744,178; and third, a manual type of sharpener which includes a means for supporting the drill bit during grinding either on a grinding wheel or a flat surface sharpening stone such as disclosed in U.S. Pat. Nos. 3,961,450; 4,164,100 and 4,566,227. A review of the grinding devices described in these U.S. patents indicates certain inadequacies that can be improved upon.

U.S. Pat. No. 3,961,450 describes a hand-held, portable sharpening device with a holder for the twist drill and an optical indicating device for sharpening using a hand-held, flat-surfaced sharpening stone. Once it is positioned in the holder, a twist drill is ready for sharpening of each cutting edge without further adjustments by moving the sharpening stone along the end faces of a pair of clamping pieces. Although simple in construction, this invention works well with small bits up to ⅛ inch in diameter but is too labor intensive for larger twist drills which require excessive amount of time to sharpen. This invention requires a lot of skill to provide satisfactory results since no means is provided for positioning the drill with respect to the grinding surface at the correct angle for obtaining the correct lip clearance angle.

U.S. Pat. No. 4,744,178 discloses a grinding device including a grinding wheel which is rotated by an electric drill, a guide to direct the drill bit at a prescribed angle to the grinding wheel with the guide being rotatable about a pivot axis to relieve the trailing edge. Due to the high speed of the hand-held electric drill and the small size of the grinding wheel that can be attached to the guide fixture, it is very difficult to control the rate of grinding and, consequently, to achieve equal cutting edges and correct clearance angles. The device is also not very suitable for grinding larger drill bits which require a larger grinding surface area for accuracy.

U.S. Pat. No. 4,031,672 describes an automatic sharpener where the grinding wheel is incorporated into the sharpener. A rotatable chuck holds the drill bit. Apparatus is provided for mounting the chuck relative to the grinding wheel so that a drill bit can be moved in a prescribed manner across the grinding periphery of the grinding wheel. A means for moving the drill bit towards the grinding wheel is provided A gauge is also provided to gauge the distance between the chuck and the surface of a grinding wheel. Since the chuck of this invention blocks the drill bit during grinding as the twist drill is advanced toward the surface of the grinding wheel, the grinding procedure has to be repeated a large number of times before a correct lip length for both cutting edges and the correct lip relief angle can be achieved.

U.S. Pat. No. 4,658,549 discloses a drill bit sharpening device which includes a drill-holding jig which includes a frame member. The frame member carries a pivot arm which is placed in a pivot arm retaining means portion of an adjustable support. A drill bit is held in the jig so that it intersects a grinding face of a grindstone at a predetermined lateral angle.

In summary, none of the patents reviewed, except for the expensive automated type, provides an accurate means of sharpening twist drill bits of all sizes, or provides adequate mathematical support for achieving the correct lip relief angle during grinding The drill bit sharpener described herein is designed to overcome these disadvantages associated with previous sharpeners by providing an accurate means for sharpening drill bits of various sizes with minimum amounts of setup time and grinding time. The required accuracy is derived from a mathematical formula that describes the inter-relationship between critical drill bit design parameters such as point angle and lip relief angle.

SUMMARY OF THE INVENTION

Before the design of the drill bit is undertaken, it is important to fully understand the variables involved in the design of a drill bit as they relate to regrinding and sharpening. A description of drill bit designs including drill grinding is in "The New American Machinist's Handbook," 1955 edition, and in the eighth edition of the "Metals Handbook" in a section entitled "Machining," Volume 3, 1967 Edition. These references do not provide mathematical formulas which show the interrelationship between the parameters required to be established for accurate drill regrinding, such as the lip relief angle, the distance of protrusion of the drill bit from the holder (which establishes the distance from the holder to the grinding surface), the lip angle, and the land angle.

It is the intention of this invention to establish mathematical formulas such that a reference chart can be provided which shows the required protrusion distance for a given relief angle, lip angle, and land angle for any particular size of drill bit. The mathematical derivations including the reference chart also helps one to better understand how one drill bit regrinding parameter affects another parameter. This is critical since operators resharpening drill bits by hand tend to remove material inefficiently, have a tendency to overgrind or undergrind the drill-bit material, and tend to quickly overheat the drill-bit material, resulting in loss of temper and sharpness.

Through an understanding of the critical parameters involved in the resharpening of drill bits, it is the general object of this invention to provide an inexpensive manual or portable drill bit sharpener that can sharpen drill bits of sizes not previously achieved on a manual sharpener, that requires minimum setup and grinding time, and that is easy to use even by an unskilled home mechanic who has had no previous experience with resharpening drill bits.

It is also an object of this invention to provide a drill bit sharpener wherein the means for holding the drill bit is rotatable about an axis parallel to the surface of the grinding wheel or stone. The correct protrusion distance of the drill bit from the holder for a given set of grinding parameters, such as the lip relief angle, is established through a lookup table and a measuring gauge in order to achieve quality resharpening.

It is another object of this invention to provide flexibility in resharpening drill bits both on the face of a grinding wheel as well as on the flat surface of a sharpening stone utilizing one single sharpener with the same drill bit holder and the same drill bit holder stand.

It is another object of this invention to provide a novel means for holding drill bits of all sizes, starting from the smallest commercially available drill bit, by providing a vise clamp device having a set of two interlocking jaws.

It is still another object of this invention to provide a means for redressing the grinding surface of a grinding wheel or of a sharpening stone by providing a means for moving the drill bit across the grinding surface in the direction of the swiveling axis.

It is another object of this invention to provide a universal stand for the sharpener that is easy to use with minimal setup and can be used with commercially available bench grinders manufactured for home use.

The objects of this invention are accomplished by providing a swiveling drill bit holder assembly, to be used with a stand or for manual grinding without a stand, which allows the drill bit to be sharpened on the flat face of a grinding wheel or a flat surfaced sharpening stone. The swiveling drill bit holder assembly includes a viseclamp for holding the drill bit at a slanted angle with respect to the grinding wheel or sharpening stone to establish the correct lip angle, typically 59° for the most common drill bit. The vise clamp is placed in a housing which includes a bottom guide plate for guiding the jaws of a vise clamp assembly, means for attaching a left handle and a right handle, means for attaching a swiveling control rod to be held by an operator during grinding, means for providing a swiveling stop, a calibrated measuring mirror gauge to establish the correct protrusion distance of the drill bit from the drill bit holder assembly to achieve the correct lip relief angle, and means for manually opening or closing, or loosening or tightening, the vise clamp assembly for insertion of the drill bit into the vise clamp. The calibrated measuring mirror gauge comprises calibrated markings inscribed into a mirror which can be swivelled out of the way once the drill bit protrusion distance is established. Means for supporting the drill bit holder assembly includes a universal adjustable-height stand which can be used with all commercial bench grinders manufactured for home use. The invention can also be used with, for example, two wooden blocks clamped to the work surface holding the grinding wheel or sharpening stone. The drill bit holder assembly can also be used manually with both hands without the use of a stand with one handle controlling the swiveling action during the grinding process.

The vise clamp of the drill bit holder assembly is designed to accommodate all sizes of drill bits starting from the smallest drill bit size. The sharpener is designed to be used with any bench grinder as well as with a flat surfaced sharpening stone without any additional attachments required either to the grinding wheel or sharpening stone. The drill bit holder assembly and stand can easily be moved away or towards the grinding surface. The drill bit holder can be inverted by simply removing the holder assembly from its stand and interchanging the position of the left and right handles on the stand. Also incorporated into the drill bit holder assembly is a mechanism for moving the drill bit across the grinding surface during resharpening, thus accomplishing a redressing of the grinding surface.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
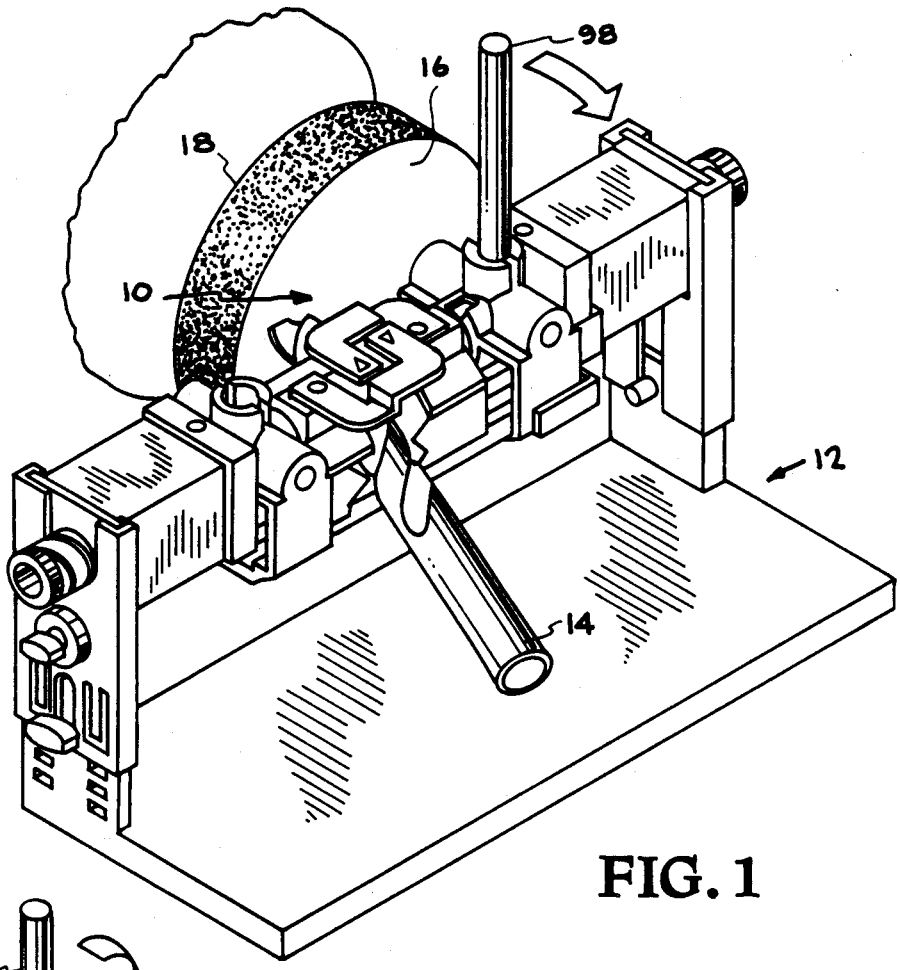
FIG. 1 is a perspective view of one embodiment of the invention with the drill bit holder assembly placed on an adjustable stand for sharpening on the flat surface of a grinding wheel.

FIG. 1 illustrates an embodiment of the invention. The sharpener includes two primary assemblies: a swiveling drill bit holder assembly 10 and an adjustable height stand 12. The drill bit holder assembly 10 provides a means for holding a drill bit 14 at a correct lip angle so that the cutting lip of the drill bit is parallel to an abrasive grinding surface 16 such as provided by the side surface 16 or, alternatively, by the peripheral surface of a rotary abrasive wheel 18. The invention includes means for setting the protrusion distance of the drill bit 14 from the holder 10 to achieve a required lip relief angle. Means are provided for swiveling, or rotating, the drill bit about an axis and against the grinding surface 16. Means are also provided for moving the drill bit 14 laterally across the grinding surface during the grinding action to achieve some degree of redressing for the grinding surface. The adjustable height stand provides a means for supporting and moving the drill bit holder assembly 10 in relation to the grinding surface 16.

Figure 2:
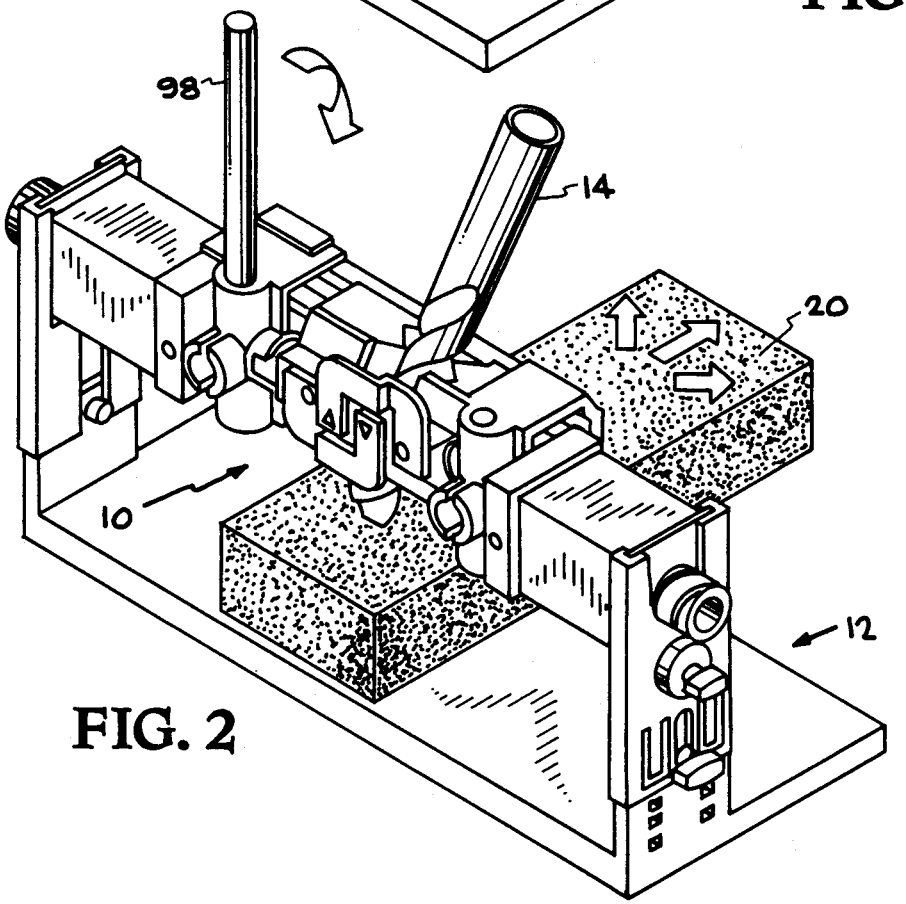
FIG. 2 is a perspective view of a similar embodiment of the invention with the drill bit holder assembly placed on an adjustable stand for sharpening on a flat surfaced sharpening stone.

FIG. 2 shows the drill bit holder assembly 10 and the stand used with a flat surfaced sharpening stone 20 for manual grinding.

Figure 3:
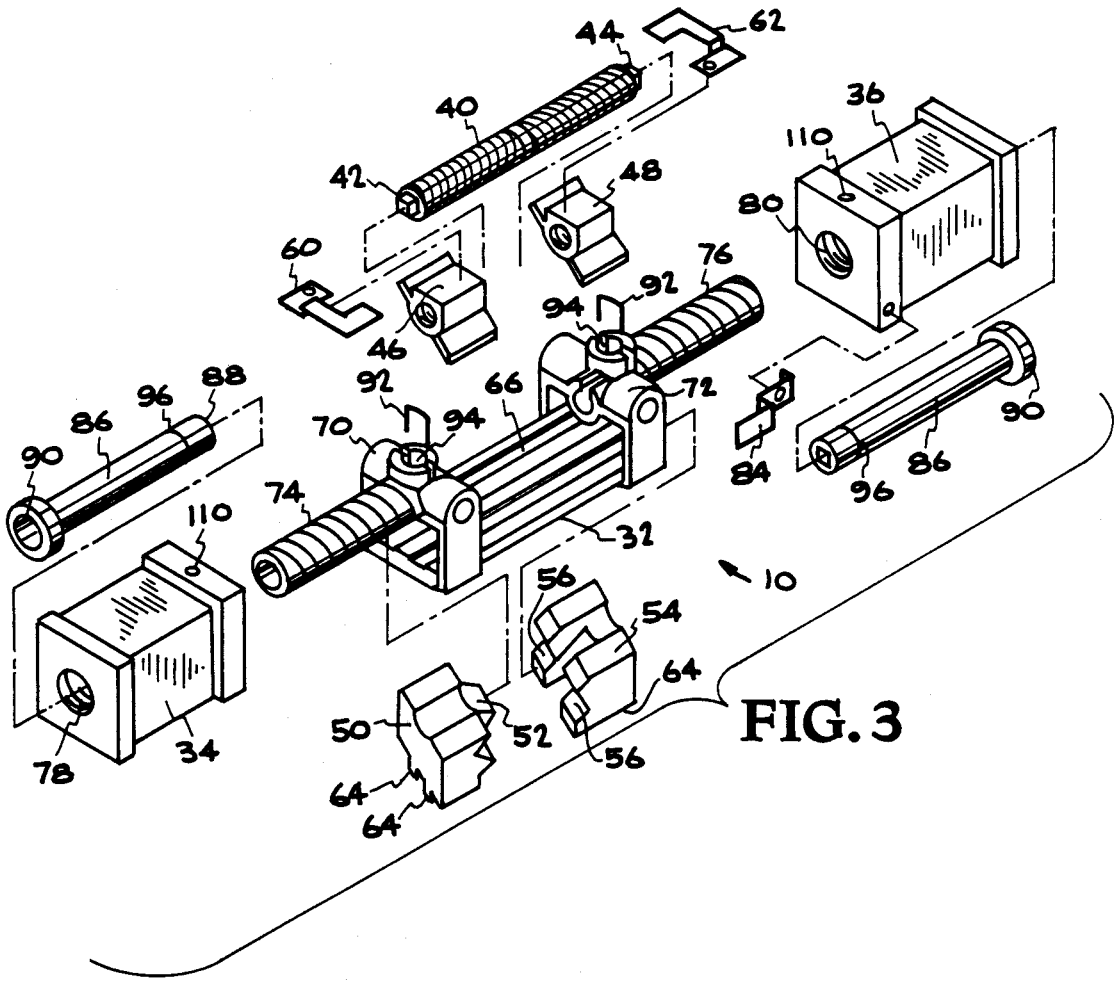
FIG. 3 is an exploded, perspective view of each of the components of the drill bit holder assembly.
Figure 4:
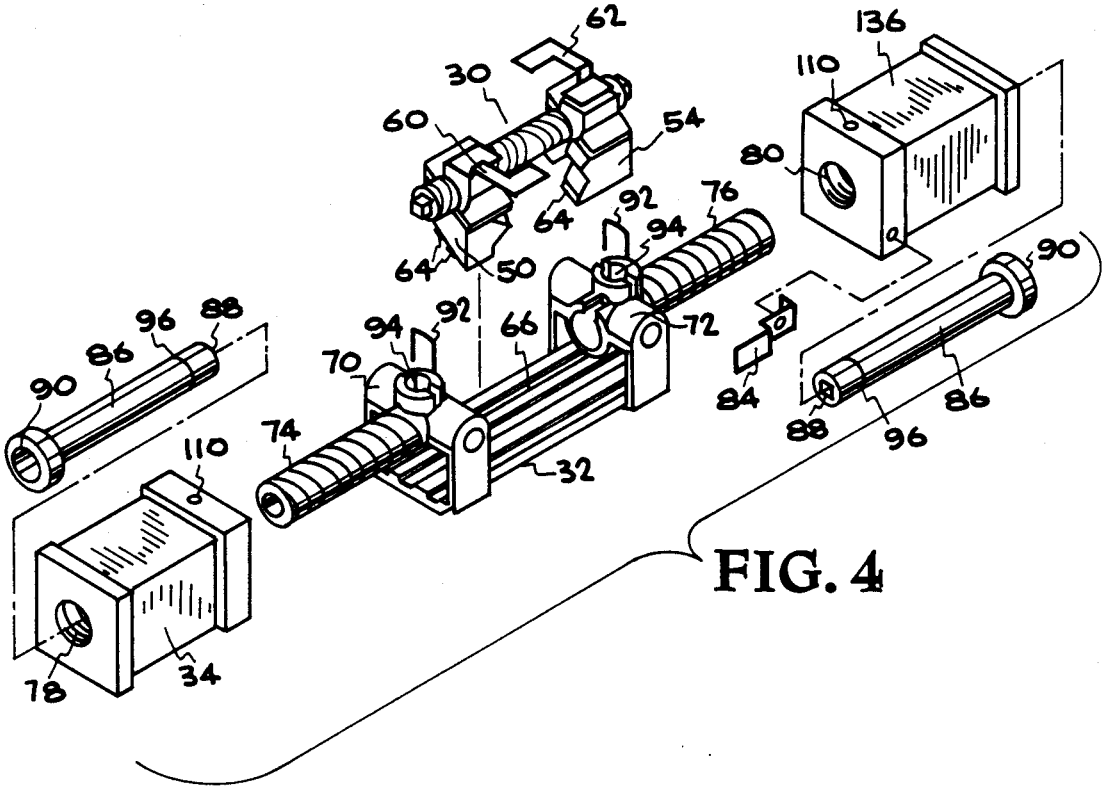
FIG. 4 is an exploded, perspective view of an assembled vise clamp assembly in relation to the other components of the drill bit holder assembly.

FIGS. 3 and 4 show the components of the drill bit holder assembly 10, including a vise clamp assembly 30 and a swiveling support 32 for the vise clamp assembly 30. A left handle 34 and a right handle 36 provide rotational support for the swiveling support 32 as it rotates about a swivel axis parallel to sharpening surface.

The vise clamp assembly 30 includes a fine threaded screw 40 which has square ends 42,44. A left internally threaded coupling 46 and a right internally threaded coupling 48 are provided with oppositely threaded internal threads to, respectively, accept the threads of the screw 40. Fixed to the bottom surface of the threaded coupling 46 for movement therewith is a left vise jaw section 50 having a projecting tooth member 52 for engaging one side of a drill bit. Similarly fixed to the bottom surface of the threaded coupling 48 for movement therewith is a right vise jaw section 54 having V-shaped recesses 56 for engaging the opposite side of a drill bit as the jaw sections 50,54 are drawn together by rotation of the screw 40 to clamp the shank of a drill bit. The axis of a drill bit caught between the jaws is slanted at an angle with respect to the swiveling axis to provide a required lip angle for a drill bit, for example, 59 degrees.

The swiveling support 32 for the vise clamp assembly 30 includes a grooved bottom plate 32 which serves to guide the left and right jaws sections 50,54 of the vice clamp assembly 30 during the opening and closing of the jaws. This is accomplished by having the left and right jaw sections 50,54 each being provided with a pair of laterally extending guide bars 64 formed on their bottom surfaces for sliding engagement with corresponding laterally extending grooves formed in the top surface 66 of the bottom plate 32.

The swiveling support 32 also includes at the respective ends of the bottom plate 32 a left end support member 70 and a right end support member 72, each of which extend upwardly. Fixed to the left support members 70 is a left spindle shaft 74, which extends laterally outwardly from the bottom plate. Coaxially fixed to the right support member is a right spindle shaft 76 extending in the opposite direction. Both of the shafts are shaped as hollow cylinders having coarse threads formed on their external surface for respective engagement with corresponding internal threads 78,80 formed adjacent to clearance bores formed through the left handle 34 and the right handle 36. The shafts 74,76 support the vise clamp 30 for rotation about a swiveling axis. If we assume that the left handle 34 and the right handle 36 are fixed in space, the coarse threads on the shafts 74,76 cause the swiveling support 32 to move laterally as the swiveling support 32 rotates about a swiveling axis defined by the coaxial axes of the shafts 74,76. This lateral movement causes a drill bit to move laterally over the sharpening surface and tends to some degree to redress or uniformly wear the sharpening surface. Fixed to the right handle 36 is a stop bracket 84 which functions to limit the rotation of the swiveling support 32. The swiveling axis is parallel to the horizontal plane in which drill bits clamped in the jaws 50,54 are positioned.

Lateral movement of the left and right jaw sections 52,54 to lock or release a drill bit in the jaws 50,54 is controlled by rotation of the fine threaded screw 40. The screw is rotated using one or both of a pair of locking pins 86. A locking pin 86 is an elongated shaft having a square recess 88 formed at one end and a concentric turning knob 90 formed at the other end. When the shafts 74,76 are threaded into the handles 34,36, the recessed end of a pin 86 passes through the hollow interior of one of the shafts 74,76 and engages one of the square ends 42,44 of the fine threaded screw 40, which is rotated by turning the knob 90. The locking pins are held in position by U-shaped spring clips 92 which are inserted through a cylindrical hole 94 formed through the top of the end support members 70,72 to engage with grooves 96 formed in the locking pins 86. The cylindrical holes 94 also function as sockets to receive one end of a cylindrical rod 98 (shown in FIGS. 1 and 2) which is used by an operator to control rotation of the vise clamp assembly 30.

Figure 5:
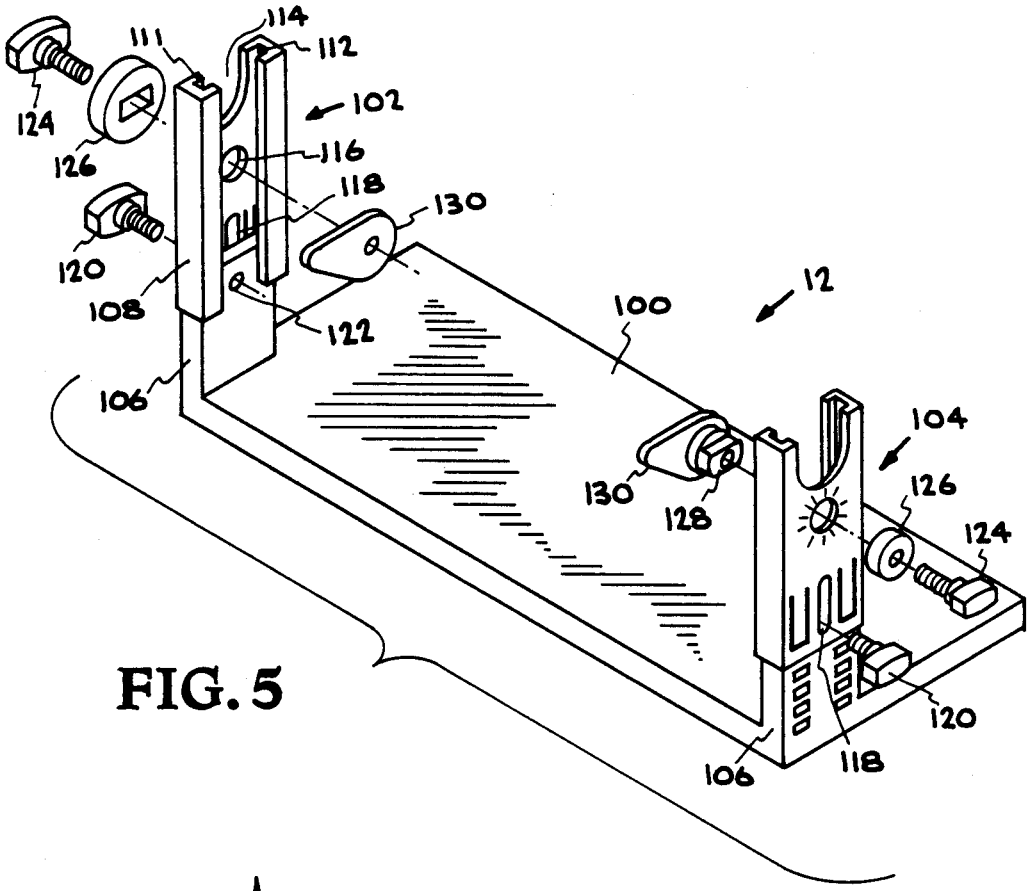
FIG. 5 is a perspective view of an adjustable height stand assembly with a means for coarse and for fine height adjustment.

FIG. 5 shows the universal adjustable height stand 12 having a bottom plate 100 which serves as a base for the stand and provides a surface for the sharpening stone 20 shown in FIG. 2 to slide on. Two vertically extending support arms 102,104 each have a fixed bottom arm member 106 and a slidably adjustable top arm member 108. The adjustable top arm 108 is shaped to have side edges which are folded to form slots 111,112 for slidable engagement with the edges of the bottom arm members 106. A U-shaped slot 114 is formed in the top arm member 108 for accommodating the drill bit holder assembly as shown in FIGS. 1 and 2. A circular hole 116 is provided for accommodating a fine adjustment screw assembly A vertical slot 118 is provided in the top arm members to accommodate a coarse adjustment screw which engages a hole 122 in the bottom arm member for coarse height adjustment of the stand. The fine adjustment screw assembly includes a screw 124, a screw nut 126 having a rectangularly slotted backside which mates with a projection 128 of a cam 130. When assembled, fine adjustment is obtained by engaging the rectangular slot of the screw nut 126 with the projection 128 of the cam 130 and twisting the screw nut 126 so that the cam 130 engages the top surface of the support arms 102,104 to move the drill bit holder assembly up or down. Locking is provided by engagement of a series of raised surfaces on the inner surface of the screw nut 126 with a sunburst pattern of indentations on the outside surface of the top arm member 108. This stand is designed to enable use of the vice clamp assembly 30 with a number of types of bench grinders.

In operation, the vise clamp assembly 30 provides a means for holding the drill bit in place during grinding. This is accomplished by turning either knob 90 at the end of one of the locking pins 86. This moves the two jaws 50,54 towards or away form each other to either clamp the drill bit in position or to release a drill bit.

Figure 7C:
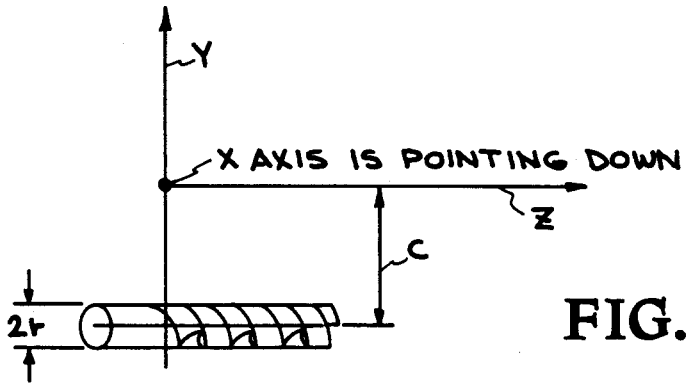
FIGS. 7A–7C are various views showing a drill bit in various planes.
Figure 7D:
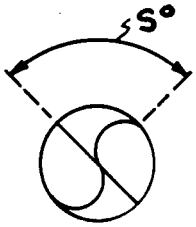
FIG. 7D is an end view of a drill bit which defines the angle S that the lip land makes with a radius to the center point of the drill.
Figure 7E:
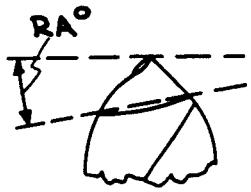
FIG. 7E is a side view of a drill bit which defines the relief angle RA for the drill bit.
Figure 7F:
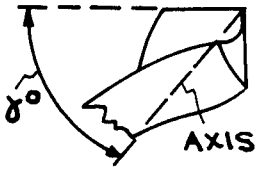
FIG. 7F is a side view of a drill bit which defines the angle which is equal to one-half of the lip angle of a drill bit.
Figure 6:
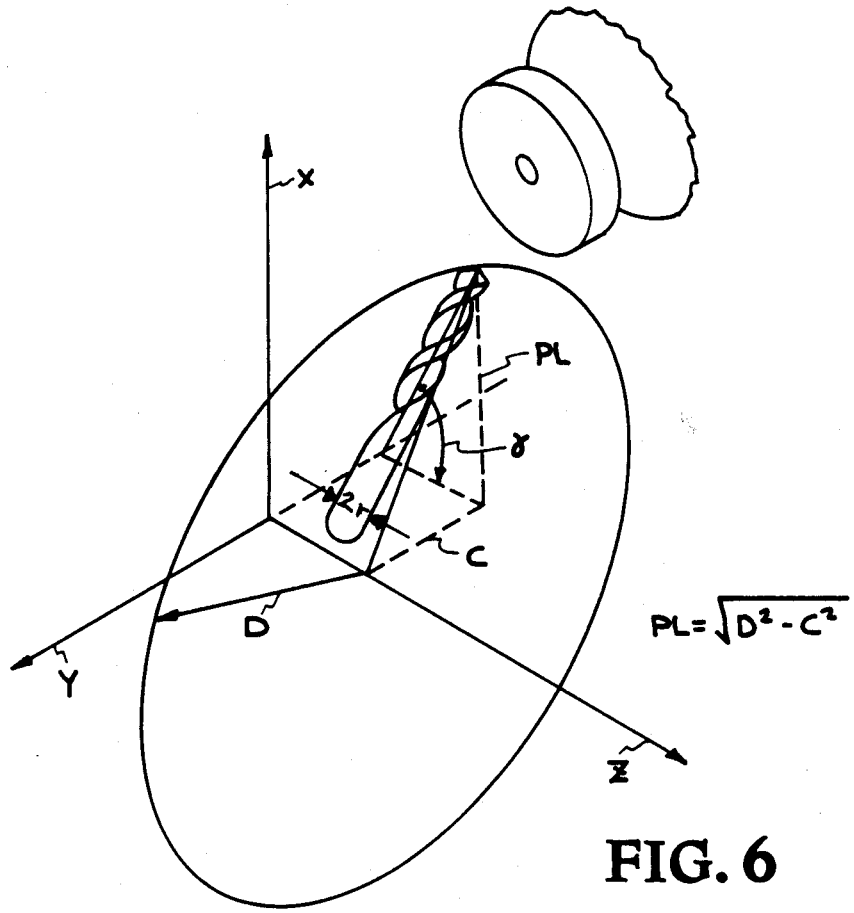
FIG. 6 is a perspective view of a drill bit oriented with respect to the X,Y,Z axes and showing the relationship of various parameters to those axes.
Figure 7A:
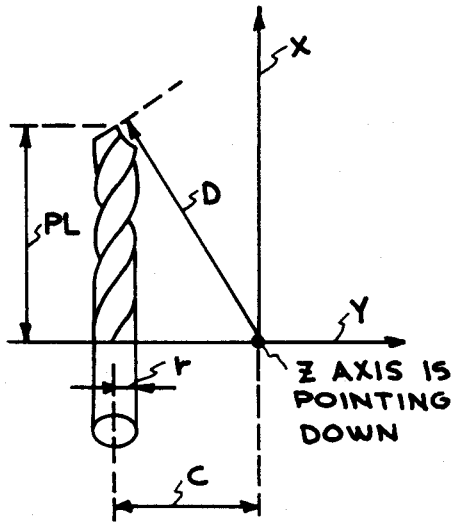
Figure 7B:
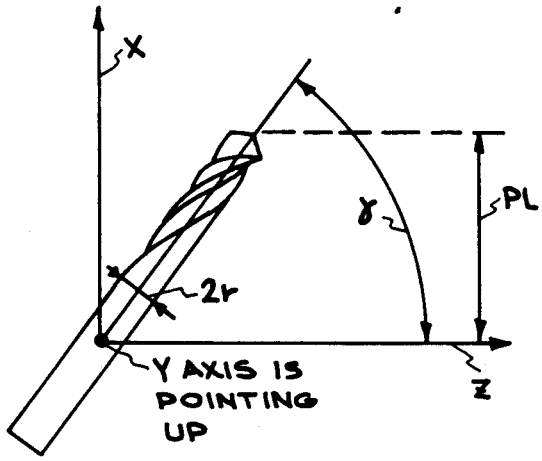

FIG. 6 is a perspective view of a drill bit and the surface of a grinding wheel shown in relation to a set of rectangular coordinate axes X, Y, and Z. The following table defines various parameters of interest:

FIGS. 7A, 7B, and 7C show views taken from FIG. 6 in various coordinate planes, as indicated in each figure.

FIGS. 7D, 7E, and 7F respectively show how the lip land angle, the relief angle, and the lip angle are measured.

The following Equation (1) is derived from the configuration of FIG. 6 which relates the various parameters defined below.

$$R.A. = 90^\circ - \arccos\left[\frac{H\sin\gamma + (H\cos\gamma - r(1 - \cos S))/\tan\gamma}{\sqrt{H^2 + r^2\sin^2 S + (H\cos\gamma + r(1 - \cos S))^2/\sin^2\gamma}}\right]$$

DEFINITIONS:

Where $$H = \sqrt{D^2 - C^2} - \sqrt{D^2 - (C + r\sin S)^2}$$

R.A.=Relief Angle r=½ of the diameter of drill

C=Distance between drill axis and X-axis or Z-axis having the drill axis perpendicular to the Y-axis D=Distance between the swivel axis (or Z-axis) and the grinding plane having Z-axis parallel to the grinding plane $\gamma$=The angle that the drill axis reclines from the Z-axis having the drill axis parallel to the X-Y plane. This angle is equal to half of the lip angle or point angle S=The angle that the lip land peripheral (which is a circular arc) makes to the radius towards the entire point)

PL=The distance between the lip that projects through the holder and the swivel axis or Z-axis plane.

$$PL = \sqrt{D^2 - C^2}$$

to be calibrated on the calibration device for a specified radius.

Figure 8:
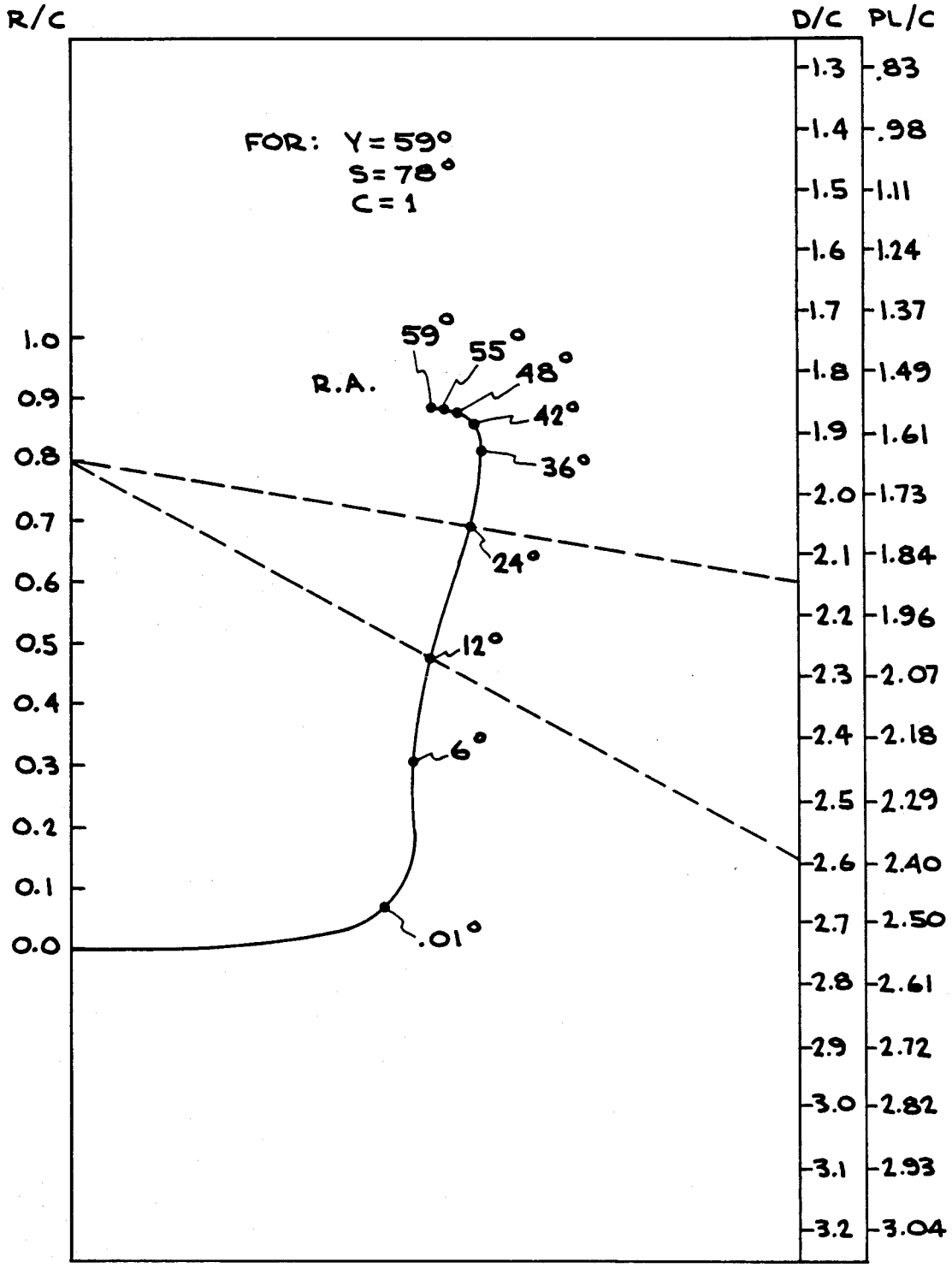
FIG. 8 is a graph showing the relationships between the drill-bit relief angle, RA, the drill bit radius, and the protrusion length, PL, for fixed values of lip angle, lip hand angle, and the distance C.

FIG. 8 is a graph which relates the relief angle, protrusion length, and drill bit radius for a 59 degree lip angle, a 79 degree lip land angle, and a distance C of 1.

To ensure a high degree of accuracy in resharpening, the interrelationship between the different parameters governing drill bit design and the sharpening process was carefully studied. These parameters included the lip relief angle "RA", the drill radius r, the protrusion distance of the tip of the drill bit from the swiveling Z-axis "PL", the distance "C", and the lip land angle and the lip angle, as depicted in FIGS. 6 and 7. Equation 1 relates these variables to obtain the lip relief angle "RA". FIG. 8 shows the results of these mathematical derivations as a graph which shows the interrelationship between the three key parameters for three fixed parameters. The graph provides a quick and accurate means for determining the protrusion distance on "PL". Selecting two of the three parameters allows the third parameter to be obtained from the graph.

Figure 9A:
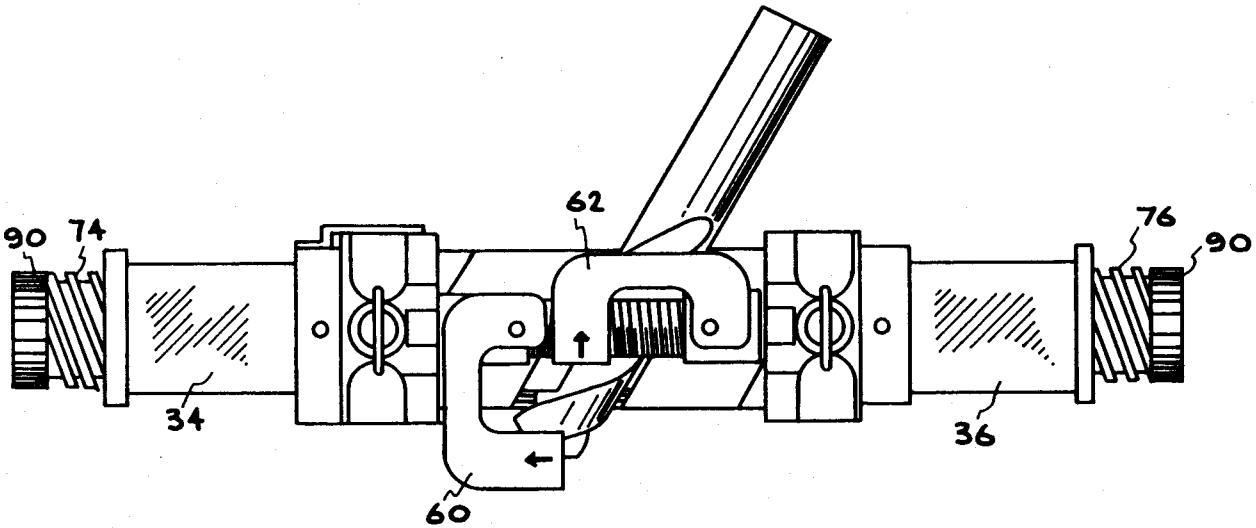
FIGS. 9A and 9B are top and bottom views, respectively, of the drill bit holder assembly showing one of the calibrated measuring mirror gauges extending outwardly for setting the protrusion length of a drill bit to be sharpened with a correct lip relief angle.
Figure 9B:
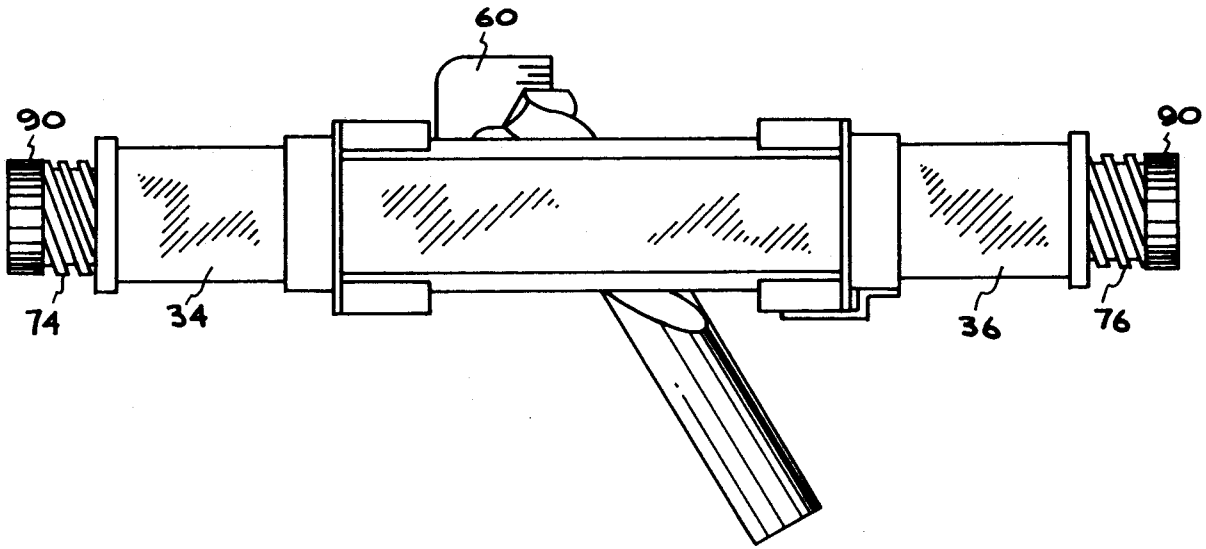

FIGS. 9A and 9B show means for setting the protrusion distance "PL" of the drill bit from the drill bit holder assembly or swiveling Z-axis, which includes the pair of calibrated measuring mirror gauges 60, 62 as illustrated in a top view and in a bottom view. The protrusion distance for a given lip relief angle "RA" for various drill bit diameters is imprinted on the calibrated gauge 9. For a given lip relief angle "RA" this provides a quick and accurate means for ensuring that the correct lip relief angle "RA" is obtained during a resharpening process.

FIGS. 9A and 9B aid in illustrating a setup procedure for sharpening a drill bit using the present invention. The jaws of the vise clamp assembly 30 are opened by turning the knob 90 of a locking pin 86. A drill bit is inserted into the jaws of the vise clamp assembly 30. The drill bit can be moved forwards or backwards until the lip of the drill bit aligns with a predetermined calibration line corresponding to a drill diameter. A radius calibrated marking can also be used where the radius is one half the diameter of the drill bit. The scale markings on the measuring gauge are used for establishing the correct protrusion distance "PL" and therefore the correct lip relief angle "RA" for a given lip angle. To set the protrusion distance "PL", the drill bit holder is inverted so that the tip of the drill bit and the measuring gauge are in full view. Upon completion of this procedure, it is important to verify that the line of cutting edge is parallel to the swiveling "Z" axis to ensure that the cutting edge is presented at the correct angle to the grinding surface before the jaws of the vise clamp assembly 30 are moved together by turning the cylindrical locking pins to lock the drill bit in place.

FIGS. 9A and 9B show one of the calibrated measuring mirror gauges 60 swung out for setting the protrusion distance "PL" as earlier described, and FIG. 9A shows the other calibrated measuring mirror gauge 62 swung to its retracted position to avoid interference with the grinding process.

Figure 10:
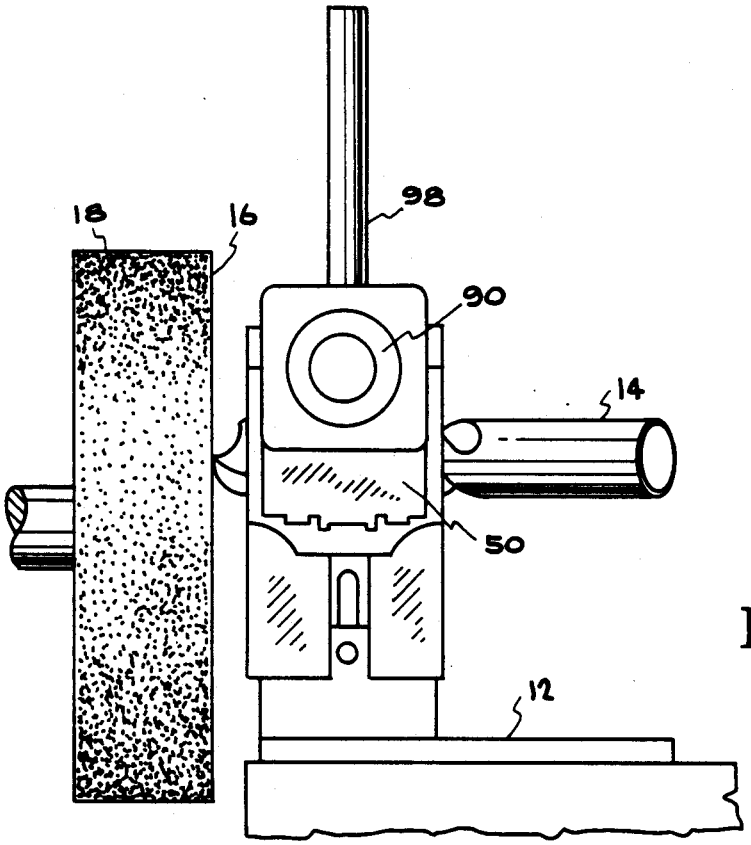
FIG. 10 is a left side view of the drill bit holder assembly in a swivelled position when the swiveling control is pulled a predetermined distance to grind a drill bit.
Figure 11:
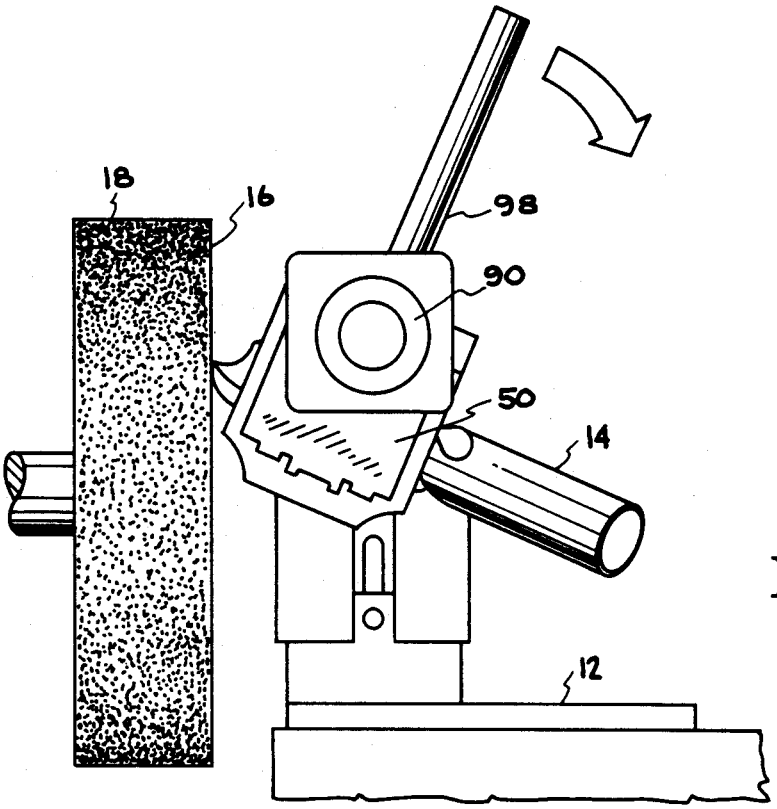
FIG. 11 is a left side view of the drill bit holder assembly prior to grinding.

As illustrated with reference to FIG. 1, with the protrusion distance "PL" set as earlier described and the measuring mirror gauges swung out of the way, the drill bit holder assembly 10 and adjustable height stand 12 are positioned such that the swiveling Z-axis, defined by the axes of the left and right spindle shafts 74,76, is parallel with the grinding surface. With an operator's left hand holding the base of the stand assembly and the operator's right hand holding the swiveling control rod 98 in a vertical position, the sharpener is carefully moved towards the grinding surface until the lip of the drill bit touches the grinding surface. The control rod 98 is then pulled towards the operator resulting in the drill bit being moved upwards across the surface of the grinding wheel. FIG. 10 is a side view showing the drill bit holder assembly at rest against the swiveling stop 84. FIG. 11 is a side view showing the drill bit holder assembly swiveled to a position after the grinding is complete. During the grinding process, gentle pressure is applied to the base platform of the stand assembly to ensure full contact of the drill bit with the grinding surface. The illustration of FIG. 1 depicts a right handed operation. For a left handed operation the swiveling rod 98 is inserted in the top cylindrical hole next to the left hand handle 34.

A lateral motion of the vise clamp assembly 30 occurs when the control rod 40 is pulled towards the user. The vise clamp assembly 30 with a clamped drill bit travels laterally to the right moving the drill bit across the grinding surface. This offers a significant operational advantage in that the sharpening of a drill bit does not occur at the same radial location on the grinding wheel. This helps prevent grooving and other damage to the grinding wheel because the sideways movement during grinding provides a means for redressing the grinding surface.

After one pass over the grinding surface, the sharpened surface is visually inspected to ensure that the cutting edge is properly sharpened and the sharpening procedure is repeated as necessary. To sharpen the other lip of a drill bit, the jaws of the vise clamp assembly are loosened and the drill bit is rotated 180 degrees such that the cutting edge of the second land area is parallel to the swiveling Z-axis and to the grinding surface without changing the drill bit protrusion distance "PL". The sharpening process is repeated until a visual inspection indicates that the length of the two cutting edges are the same and the required lip relief angle has been obtained. This sharpener requires minimum skill to operate and sharpening quality improves with practice.

FIG. 2 is a preferred embodiment which illustrates means for sharpening a drill bit using a sharpening stone 20. This procedure is more suitable for smaller drill bits under ⅛ inch in diameter, since this procedure has a rate of removal of metal from the tip of a drill bit which is lower than the rate obtained by using a grinding wheel. The speed of sharpening is controlled manually by the user by controlling the rate of swiveling. In this means, after the protrusion distance "PL" has been set, as earlier described, the drill bit holder assembly is placed on the stand assembly with the drill bit pointing downwards and a sharpening stone 20 placed on the base of the stand assembly. The height of the stand assembly is adjusted per the procedure as described earlier. The swiveling action is accomplished by moving the swiveling control rod 98 through an arc sufficient to sharpen the entire land area of a drill bit as illustrated in FIG. 2. The operator's other hand moves the sharpening stone in a forward and backward motion as indicated. The primary disadvantage associated with other sharpeners, which utilize a grinding wheel on a bench grinder or attached to a portable drill, is that equal cutting edges cannot be obtained without a large number of trials, due to the high rate of removal of metal from the drill bit during grinding with a wheel. This embodiment of the invention eliminates this disadvantage associated with using grinding wheels by providing a manual means for controlling the grinding speed. This results in improved resharpening quality for smaller drill bits. To manually sharpen the other lip angle, the same procedure of loosening the jaws of the vise clamp assembly and rotating the drill bit 180 degrees is used as described previously. Redressing of the grinding surface is also achieved in this embodiment of the invention.

Figure 12:
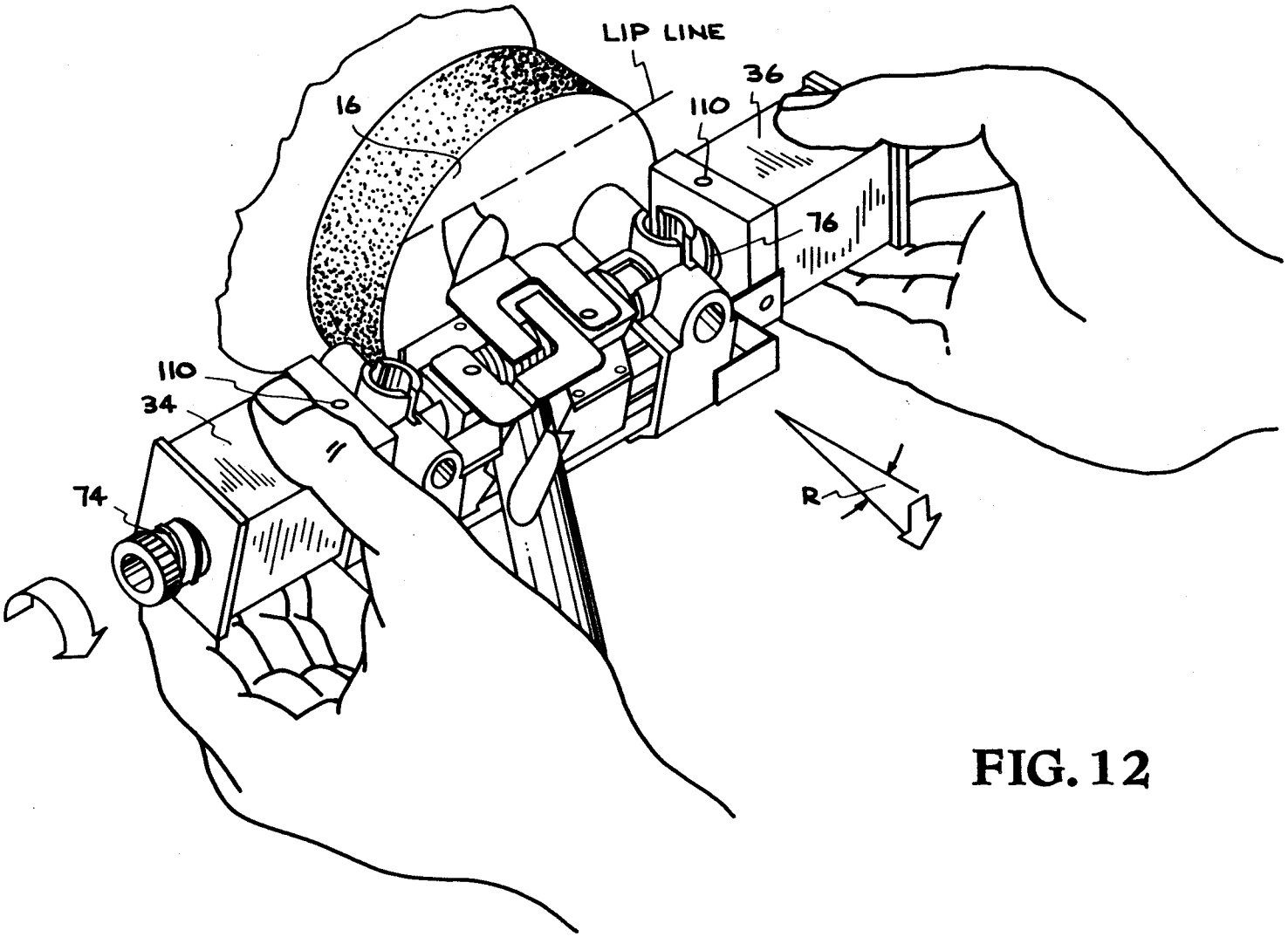

FIG. 12 illustrates the use of the sharpener without the use of a stand. An operator uses both hands to hold the handles 34,36 of the drill bit holder assembly 10. To utilize this apparatus for manual sharpening, a means is provided for locking one handle in place, which allows the other handle to support the holder assembly for rotation. A locking screw 110 fixes a handle to its respective spindle shaft 74,76. This allows for either left hand or right hand swiveling operation. For right hand swiveling operation the left hand handle is locked in place with the screw provided and vice versa. The grinding process is achieved by turning the handle 4 such that the drill bit is swiveled upwards across the grinding surface. Inspection of the sharpened lip of the drill bit and sharpening of the second lip involves the same procedures as explained in connection with FIG. 1. The same redressing of the grinding surface is also achieved here. This grinding procedure may be selected by the user who feels more comfortable with manually controlling grinding.

Other means for supporting the drill bit holder assembly during grinding can be used. For example, a pair of blocks of a suitable material such as, for example, wood are attached to a work surface and serve as supports for the handles in a manner similar to that provided by the stand 12.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A drill bit sharpener for sharpening a drill bit against an abrasive sharpening surface, comprising:

drill holder means for holding said drill bit at a lip angle with respect to the sharpening surface so that the cutting lip edge of said drill bit is parallel to said sharpening surface;

swivel means for swiveling the drill holder means about a swivel axis, which swivel axis is parallel to said sharpening surface so that a relief angle is cut by said sharpening surface in said drill bit as said drill holder means swivels about said swivel axis;

means for controlling the protrusion of said drill bit from said means for holding so that a predetermined relief angle is cut in said drill bit by said sharpening surface;

wherein the means for controlling protrusion of said drill bit includes means for setting the protrusion of said drill bit to a precise length (PL) as equivalently determined by the equation $$R.A. = 90^\circ - \arccos\left[\frac{H\sin\gamma + (H\cos\gamma - r(1 - \cos S))/\tan\gamma}{\sqrt{H^2 + r^2\sin^2 S + (H\cos\gamma + r(1 - \cos S))^2/\sin^2\gamma}}\right]$$

DEFINITIONS:

Where $$H = \sqrt{D^2 - C^2} - \sqrt{D^2 - (C + r\sin S)^2}$$

R.A.=Relief angle;

r=Drill bit radius equal to ½ of the diameter of drill;

C=Distance between the drill axis and the swivel axis;

D=Distance between the swivel axis and the grinding plane;

$\gamma$=The angle that the drill axis declines from swivel axis which is equal to half of the lip angle or point angle of said drill bit;

S=The lip land angle;

PL=The distance between the drill bit lip and the swivel axis where $$PL = \sqrt{D^2 - C^2}.$$

2. The drill bit sharpener of claim 1 wherein said drill holder means includes:

a base member;

vise means for adjustably clamping the shank or flute body of said drill bit, said vise means including opposing jaw members slidably mounted to said base member for engaging the shank or flute body of said drill bit;

handle means rotatedly coupled to said base member for swiveling said drill holder means about said swiveling axis.

3. The drill bit sharpener of claim 2 wherein said vise means includes threaded means for adjusting the position of said opposing jaw members.

4. The drill bit sharpener of claim 2 wherein said handle means includes a left handle assembly and a right handle assembly, each including means for rotatably supporting said drill holder means for rotation about said swiveling axis.

5. The drill bit sharpener of claim 4 wherein said handle means includes means for fixing one of said left or said right handle assemblies to said drill holder means so that a force for rotating said drill holder means is coupled from one of said handle assemblies to said drill holder means.

6. The drill bit sharpener of claim 1 including support stand means for holding said drill holder means in position with respect to said sharpening surface.

7. The drill bit sharpener of claim 6 wherein said support stand means includes means for adjusting the height of said drill holder means with respect to said sharpening surface.

8. The drill bit sharpener of claim 7 wherein said support means includes a horizontally disposed support base member having a pair of opposing, upwardly extending vertical support members and wherein said support means includes means for adjustably fixing said swivel means to said vertical support members for adjusting the height of said drill holder means with respect to said support base member.

9. The drill bit sharpener of claim 1 including means for moving said drill holder means in a direction along said swiveling axis to provide for redressing of said sharpening surface by the sharpening action of said drill bit laterally over said sharpening surface.

10. The drill bit sharpener of claim 9 wherein said means for moving includes screw thread means for moving said drill holder as said swivel means is rotated about said swiveling axis.

11. The drill bit sharpener of claim 1 wherein the means for setting the protrusion of said drill bit includes gauge means with calibrated markings for setting the protrusion length of said drill bit to a predetermined value in accordance with said equation.

12. A method of sharpening a drill bit against an abrasive surface, comprising the steps of:

holding said drill bit with a drill bit holder at a lip angle with respect to the sharpening surface so that the cutting lip edge of said drill bit is parallel to said sharpening surface;

using a handle assembly for rotatably supporting said drill bit holder swiveling the drill bit about a swiveling axis, which swiveling axis is parallel to said sharpening surface so that a relief angle is cut by said sharpening surface in said drill bit as said drill holder means swivels about said swiveling axis;

controlling the protrusion of said drill bit from said drill bit holder so that a predetermined relief angle is cut in said drill bit by said sharpening surface as said drill bit is swivelled about said swiveling axis;

wherein the step of controlling the protrusion of said drill bit includes the step of setting the protrusion of said drill bit to a precise length PL as equivalently determined by the equation:

$$R.A. = 90^\circ - \arccos\left[\frac{H\sin\gamma + (H\cos\gamma - r(1 - \cos S))/\tan\gamma}{\sqrt{H^2 + r^2\sin^2 S + (H\cos\gamma + r(1 - \cos S))^2/\sin^2\gamma}}\right]$$

DEFINITIONS:

Where $$H = \sqrt{D^2 - C^2} - \sqrt{D^2 - (C + r\sin S)^2}$$

R.A.=Relief Angle r=drill bit radius equal to ½ of the diameter of drill

C=Distance between drill axis and the swivel axis

D=Distance between the swivel axis and the grinding plane, $\gamma$=The angle that the drill axis declines from swivel axis which is equal to half of the lip angle, or point angle of said drill bit, S=The lip land angle, PL=The distance between the drill bit lip and the swivel axis, where $$PL = \sqrt{D^2 - C^2}.$$

13. The method of claim 12 including the step of adjustably clamping the shank of said drill bit in opposing jaw members slidably mounted to a base member portion of said drill bit holder.

14. The method of claim 12 including the step of rotatably supporting said drill holder means for rotation about said swiveling axis in a handle assembly.

15. The method of claim 14 including the steps of fixing a handle of said handle assembly to said drill holder and manually rotating said drill holder means using said fixed handle.

16. The method of claim 12 including the step of supporting said drill bit holder means in position with respect to said sharpening surface with a support stand.

17. The method of claim 12 including the step of moving said drill bit holder laterally over said sharpening surface in a direction along said swiveling axis to provide for redressing of said sharpening surface by the sharpening action of said drill bit laterally over said sharpening surface.

* * * * *